United States Patent [19]

Barrios et al.

[11] Patent Number: 5,008,967

[45] Date of Patent: Apr. 23, 1991

[54] TRIANGULAR TRUSS WALKOUT CANTILEVER

[75] Inventors: Richard C. Barrios; Philip A. Hayes, both of Louisville, Ky.

[73] Assignee: Modern Industries, Inc., Louisville, Ky.

[21] Appl. No.: 379,551

[22] Filed: Jul. 13, 1989

[51] Int. Cl.[5] ..... B61L 5/12; E04C 3/02; E04H 12/10

[52] U.S. Cl. ..... 14/7; 52/28; 52/73; 52/638; 52/693; 246/477

[58] Field of Search ..... 14/3, 4, 7, 6, 13, 14, 14/17, 71.1, 8; 52/73, 638, 648, 690, 693, 27, 28, 40, 721, 649, 692; 40/605, 606, 312; 246/477, 484, 293; 104/124

[56] References Cited

U.S. PATENT DOCUMENTS

| | | | |
|---|---|---|---|
| 2,066,388 | 1/1937 | Birkin | 52/648 |
| 3,345,793 | 10/1967 | Cvikl | 52/693 |
| 3,562,994 | 2/1971 | Von Linsowe | 52/690 |
| 3,570,196 | 3/1971 | Kunczynski | 52/40 |
| 3,952,978 | 4/1976 | Reinitz | 246/477 |
| 4,489,659 | 12/1984 | Kamohara et al. | 104/124 |
| 4,633,566 | 1/1987 | Coppa | 29/429 |

OTHER PUBLICATIONS

Safetran Cantilevers brochure covering Models AR-C-100, W, and WNR.

Brochure entitled "Cantilever Model 320A".

Western-Cullen brochure entitled "WC Stationary (Walkout) Cantilevers".

*Primary Examiner*—Stephen J. Novosad

*Attorney, Agent, or Firm*—D. A. N. Chase

[57] ABSTRACT

A triangular truss walkout cantilever for displaying railroad warning signals above the individual lanes of a road or highway at a railroad grade crossing is disclosed. The cantilever includes a cantilever arm attached to a vertical roadside mast. The cantilever arm has three parallel truss members that form a triangular cross section. These members are reinforced by a system of struts and braces. A catwalk allows a worker access to the warning signals for maintenance and no braces interfere with such access.

4 Claims, 2 Drawing Sheets

TRIANGULAR TRUSS WALKOUT CANTILEVER

BACKGROUND OF THE INVENTION

1. Field of the Invention

The present invention is directed to a self-supporting cantilevered arm attached to a vertical mast to provide a cantilever structure especially adapted to support lighted signals along a railroad, such as traffic signals at a grade crossing.

2. Description of Related Art

Some type of warning system is usually installed at grade crossings where railroad tracks cross a road or highway. Increasingly, governments require overhead warning lights and signals. State Departments of Transportation now typically require a set of signal lights in each lane of the roadway.

In addition, each light in such a warning display must be equipped with a restrictive filter that concentrates the light to be seen in the lane directly in front of the light. To meet this requirement, lens filters for overhead lights must direct the light into a cone having a total horizontal field of twenty degrees (20°), i.e. ten degrees (10°) to the left of the light's center line and ten degrees (10°) to the right of the light's center line, and a total vertical field of thirty-two degrees (32°) down, i.e. zero degrees (0°) up from the light's center line and thirty-two degrees (32°) down from the light's center line. To ensure that the resulting cone of light will be seen by a car in the lane in front of the light, the structure upon which the light is mounted must be fixed and not subject to excessive deflection.

The American Association of State and Highway Transportation Officials (AASHTO) also sets deflection and other performance criteria for such cantilevers. In a wind of 130 miles per hour (209 kph), that is, a Beaufort number greater than 17, a cantilever boom of any length is allowed to have a maximum vertically downward deflection of six inches (6") (15.24 cm) from the unstressed equilibrium position, and a maximum horizontal angular deflection of three degrees fifteen minutes (3° 15') in front of or behind the equilibrium position. These are the maximum deflections that will allow the cone of light from each warning lamp to be seen by a driver in the lane beneath it. Such structures also should withstand snow and ice loading of three pounds per square foot and a live load of 500 pounds (186.5 kg) at the end of the cantilevered boom without exceeding these same deflection standards.

One approach to meeting such requirements is to build an elevated truss spanning the entire roadway and supported at both ends. This solution has generally not been commercially undertaken because it is too costly, since the truss need not cross the entire roadway but only the lanes of traffic that travel in one direction.

One prior art approach to the problem of providing overhead warning signals at grade crossings is a cantilever having a vertically disposed mast fixed to a supporting pad, such as a poured concrete pad embedded in the ground, and having a cantilever arm attached to the mast. The cantilever arm includes three main members, two of which form a triangular base disposed in a horizontal plane, and the third member is spaced above these two bottom members. Reinforcing members maintain the orientation of the three main members. Such structures, however, are not self-supporting. Instead, much of the support for the cantilevered arm comes from a pair of tensioned cables strung between the top of the mast and cable-retaining fixtures near the convergent end of the bottom members of the arm.

Such structures typically will not hold a 500 pound (186.5 kg) live load and are only good for a two-lane road at best. They will not support a walkway or a worker. Instead, whenever the warning lamps or signals require any maintenance or inspection, a hand crank is turned, swinging the cantilevered arm into a position parallel with the road and a supplied ladder is placed against the cantilevered arm at the spot where work is needed. Naturally, a worker must climb down the ladder and move it in order to work on more than one lamp or signal fixture.

Furthermore, the cables that hold the cantilevered arm must be tightened annually because they stretch. Eventually, the cables will stretch beyond their limit and must be replaced. If this maintenance is neglected, the result could be the collapse of the cantilevered arm.

Another proposed solution to the problem of providing overhead warning systems at grade crossings is a cantilevered arm consisting of a rectangular frame with some reinforcing members between the two long sides of the rectangle. The frame is oriented in a vertical plane and cantilevered from a mast. Such a cantilevered arm may include a walkway, allowing the maintenance worker to walk along inside the length of the arm to work on the lighting and warning fixtures. The space for walking inside the arm is small and restrictive. Moreover, the cost of this type of structure is high.

Accordingly, there is a significant need for an overhead cantilevered boom warning signal carrier for railroad grade crossings that can be extended to a length of forty feet (40') (12.19 km) while maintaining the necessary strength; that can carry a 500 pound (186.5 kg) live load at the end of the arm without deflecting more than six inches (6") (15.24 cm) downward; that will withstand a 130 miles per hour (209 kph) wind with a maximum vertical deflection of six inches (6") (15.24 cm) downward and a maximum horizontal angular deflection of plus or minus three degrees fifteen minutes (3° 15') from equilibrium at the end of a forty foot (40') (12.19 m) long cantilever boom; that includes a catwalk for allowing easy access to the lighting fixtures; that allows the worker ready access to the lighting and warning fixtures without any superstructure members to crawl around or under; that remains in place over the roadway during maintenance on the warning fixtures, obviating the need to rotate the cantilevered boom; that weighs less than cantilevered booms of the prior art; and that is less expensive to manufacture, transport and erect than cantilevered booms in present use.

OBJECTS OF THE INVENTION

Accordingly, it is an object of the invention to provide a triangular truss walkout cantilever having a cantilevered arm that can be extended to a length of forty feet (40') (12.19 m) while maintaining the desired strength.

It is a further object of the invention to provide a triangular truss walkout cantilever that can carry a 500 pound (186.5 kg) live load at the end of the truss arm without deflecting downward more than six inches (6") (15.24 cm).

It is a further object of the invention to provide a triangular truss walkout cantilever that will withstand a 130 miles per hour (209 kph) wind with a maximum vertical deflection of six inches (6") (15.24 cm) downward and a maximum horizontal angular deflection of plus or minus thirty degrees fifteen minutes (30° 15′) from equilibrium at the end of a cantilever arm 12′ (3.7 m) to and including forty feet (40′) (12.19 m) long.

It is another object of the invention to provide a triangular truss walkout cantilever that includes a catwalk for allowing easy access to the lighting and warning fixtures.

It is a further object of the invention to provide a triangular truss walkout cantilever that allows a worker ready access to the lighting and warning fixtures without any superstructure members to crawl around or under.

It is another object of the invention to provide a triangular truss walkout cantilever that can remain in place over the roadway during maintenance on the lighting and warning fixtures, obviating the need to rotate the cantilevered arm.

It is a further object of the invention to provide a triangular truss walkout cantilever that weighs less than cantilevered booms of prior designs.

It is a further object of the present invention to provide a triangular truss walkout cantilever that is less expensive to manufacture, transport and erect than cantilevered booms in present use.

The triangular truss walkout cantilever achieves these and other objects of the present invention by providing a vertical mast having a cantilever arm attached to the top of it. The cantilever arm includes three primary members, or longitudinal truss members, that are mutually parallel and form a uniformly triangular cross section throughout their length. In a preferred embodiment, the triangular cross section is an isosceles cross section. The triangular truss walkout cantilever is provided with means for interlocking the three longitudinal truss members, which comprise a variety of internal braces and supports. Also included is a horizontally disposed catwalk joined to the bottom truss members by a plurality of supporting ribs, and including a handrail supported by vertical handrail supports.

A cantilever arm less than twenty-five feet (25′) (7.6 m) long may be supported by a single ten and three-quarter inch outside diameter (10¾″ O.D.) (27 cm), tubular aluminum mast. When the cantilever arm is twenty-five to thirty feet (25′ to 30′) (6 m to 9.2 m) long, a double mast consisting of two eight and five-eighths inch outside diameter (8⅝″ O.D.) (22 cm), tubular aluminum masts is used. Alternatively, galvanized steel masts can be employed. In either case, the bottom of the truss arm is intended to be seventeen and one-half feet (17½′) (5.33 m) from the road beneath it, with a minimum clearance of seventeen feet (17′) (5.2 m)

In a preferred embodiment, all structural members of the triangular truss walkout cantilever are aluminum.

More particularly, the triangular truss walkout cantilever comprises a base adapted to overlie a supporting pad; at least one vertically disposed mast having a bottom end and a top end, said bottom fixed to said base; a horizontally disposed truss arm having a mounting end and a free end, with said mounting end attached to said mast proximate said top end of said mast, said truss arm including three longitudinal truss members disposed parallel to one another, said truss members including a first bottom truss member, a second bottom truss member and a top truss member, said longitudinal truss members forming a cross sectional triangular pattern having a horizontal base and an upwardly projecting apex; means for interlocking said longitudinal truss members; a plurality of cross members disposed in the plane of said first and second bottom truss members, between said first and second bottom truss members, and perpendicular to said first and second bottom truss members, said cross members being attached to said first and second bottom truss members, thereby forming a series of bottom rectangles; at least one bottom brace within each said rectangle disposed along a diagonal of said rectangle; a plurality of side braces attached to and extending from said first bottom truss member to said top truss member and joined thereto; a plurality of side braces attached to and extending from said second bottom truss member to said top truss member and joined thereto; a plurality of vertical braces attached to and extending from said cross members to said top truss member and joined thereto; and a plurality of center diagonals attached to and extending from said cross members to said top truss member.

Through a computer simulation stress analysis and subsequent field tests of the triangular truss walkout cantilever of the present invention, it has been found that the primary truss members can be made from smaller diameter aluminum tubing than was previously customary, due to the strength and stiffness of the mast and cantilevered arm. In particular, primary truss members of three inches (3″) (7.62 cm) may be used with cantilever arms of twelve feet to twenty-eight feet (12′ to 28′) (3.7 m to 8.6 m); and primary truss members of four inches (4″) (10.2 cm) may be used with cantilever arm of twenty-nine feet to forty feet (29′ to 40′) (8.9 m to 12.2 m). This results in less wind resistance in the finished installed cantilever, and in significant weight reductions, which save money in manufacturing, shipping and installing such cantilevers. The primary members comprise the first bottom truss member, the second bottom truss member, the top truss member, and the vertical braces. A triangular truss walkout cantilever made in accordance with the teachings of the present invention and having a cantilever arm forty feet (40′) (12.19 cm) long can exhibit a downward deflection of only three inches (3″) (8.62 cm) when subjected to a 1,000 pound (454 kg) live load at the free end of the cantilever arm. In addition, such a cantilever arm weighs only about 720 pounds (326.9 kg). Eight warning lights add about another 160–300 pounds (72.6–145.2 kg) to the total dead load, providing a lightweight cantilever arm for a structure of this size.

Other objects and advantages of the invention will become apparent from the following description taken in connection with the accompanying drawings, wherein is set forth by way of illustration and example, an embodiment of the invention.

DESCRIPTION OF THE PREFERRED EMBODIMENT

Figures 2, 3, 4:
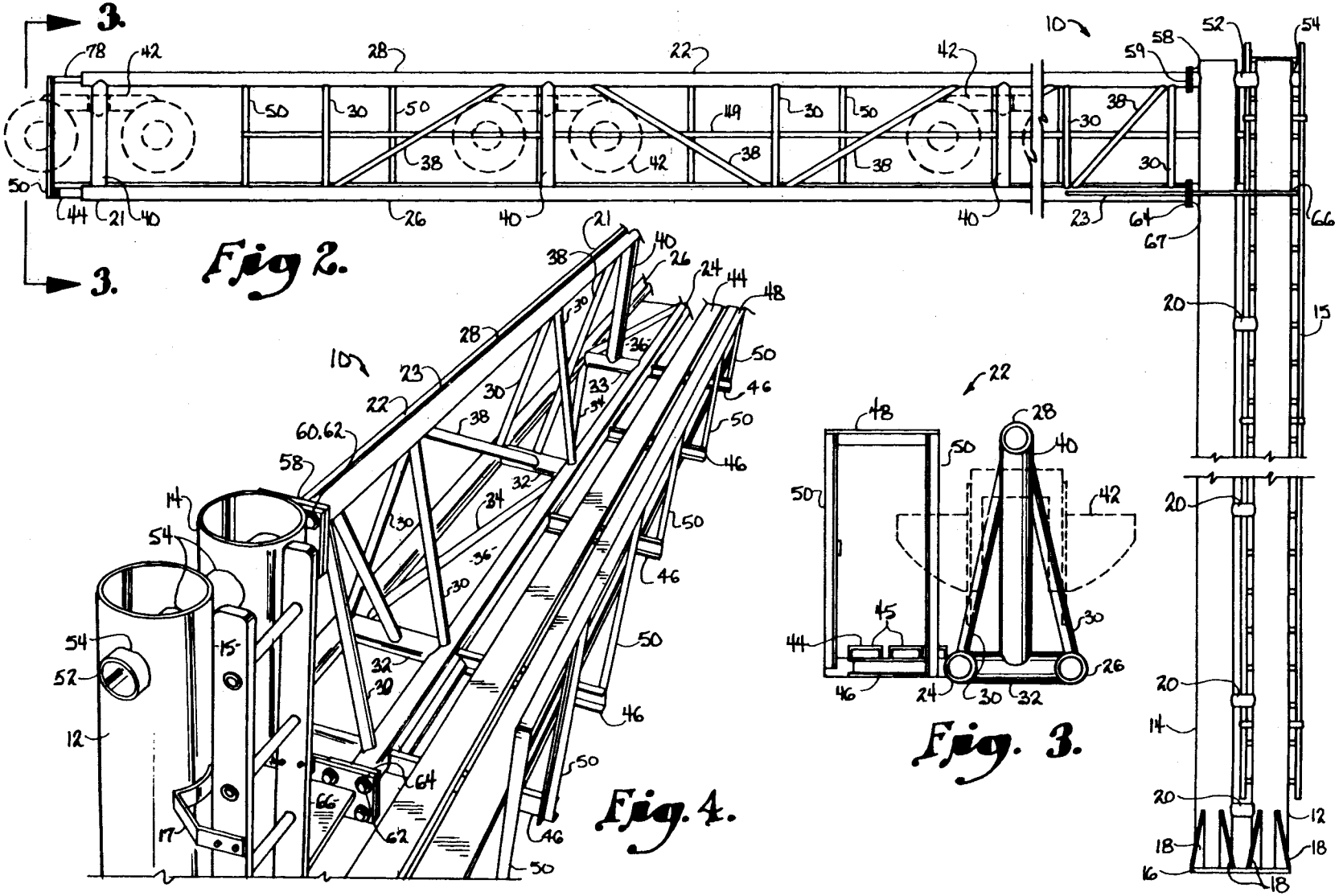
FIG. 2 is a front elevation of the triangular truss walkout cantilever featuring a double mast model.
FIG. 3 is a cross section taken along lines 3—3 of FIG. 2.
FIG. 4 is a fragmentary perspective view of the triangular truss walkout cantilever viewed from the mast end.

Referring to FIG. 2, there is shown a triangular truss walkout cantilever 10 having a first mast 12, a second mast 14, which are both vertical and are fixed to a supporting pad (not shown). The supporting pad may be, for example, poured concrete embedded in the ground and having a plurality of spaced bolts embedded therein and protruding from the top of the supporting pad. A base plate 16 or other base is fixed to the bottom ends of masts 12, 14 by means of welding or the like and the connection is reinforced by a plurality of triangular struts 18 that are welded to base plate 16 and masts 12, 14. Three triangular struts 18 are equally spaced about the circumference of each mast 12, 14. Four reinforcing spacer members 20 are horizontally disposed between first mast 12 and second mast 14, and welded thereto at each end, to maintain the parallel relationship between the masts 12, 14. In a preferred embodiment, masts 12, 14 are made from approximately ten inch (10") (25.4 cm) diameter tubular aluminum. If the cantilever arm is less than twenty-five feet (7.6 m) long, only one such aluminum mast is required. Base plate 16 includes a plurality of apertures which align with the bolts protruding from the supporting pad, allowing the triangular truss walkout cantilever 10 to be fixed to the supporting pad by nuts.

A ladder 15 is fixed to mast 12 by ladder brackets 17 for allowing workers to climb to catwalk 44 easily. A locked anti-climbing device (not shown) may be included at the lower end of ladder 15 to discourage unauthorized use of ladder 15.

Truss arm 22 includes three longitudinal truss members disposed parallel to one another, forming a triangular cross section throughout their length (see FIG. 3), and numerous reinforcement members. First bottom truss member 24 and second bottom truss member 26 are parallel and define a horizontal plane. Top truss member 28 is disposed above truss members 24, 26 to form an isosceles triangular cross section, that is, top truss member 28 is disposed parallel to the center line between first bottom truss member 24 and second bottom truss member 26, and is vertically disposed above that center line. Thus, all side braces 30 are of equal length.

Cross members 32 are disposed between first bottom truss member 24 and second bottom truss member 26, and are perpendicular to both bottom truss members and lie in the plane defined by the bottom truss members 21, 26. A plurality of spaced parallel cross members 32 is employed, with six cross members being used in the model shown in FIG. 2.

A bottom brace 34 lies in the plane defined by first bottom truss member 24 and second bottom truss member 26 and forms a diagonal brace across each rectangular frame formed by bottom truss members 24, 26 and two adjacent cross members 32. Bottom braces 34 are arranged so that each pair of adjoining rectangles 36 includes a common cross member 32, (or 33, see below) joined at one of its ends to bottom member 24 or 26 at the proximal ends of adjacent braces 34, thereby forming a zigzag pattern of bottom braces 34 in the plane of first bottom truss member 24 and second bottom truss member 26.

Referring to FIG. 4, the triangular truss walkout cantilever 10 further includes a plurality of center diagonals 38. A center diagonal 38 is attached to the middle of the length of cross member 32 and runs to the bottom of top truss member 28 at an angle of between about thirty to seventy-five degrees (30°–75°) and is fastened to top truss member 28. In the preferred embodiment disclosed herein, two center diagonals 38 are attached to a single cross member 32, with one center diagonal 38 leaning toward the mast end or mounting end 23 of truss arm 22 and the other center diagonal 38 leaning toward the free end 21 of truss arm 22. Center diagonals 38 may be fixed to each cross member 32, or to every other cross member 32, as shown in the figures.

A plurality of spaced parallel vertical braces 40 are fixed to the mid-point of cross members 33 and to the bottom of top truss member 28. Cross members 33 are the same part as cross members 32. Cross members 32, however, have attached to them side braces 30, which appear vertical in elevation, that is, they lean inward from the outer corner of the isosceles triangle cross section of truss arm 22 to the apex of that triangle (as shown most clearly in FIG. 3). Alternatively, side braces 30 may be configured to display in front elevation an angle relative to the vertical of from about twenty degrees (20°) to about fifty degrees (50°). Cross members 32 are also provided with the center diagonals 38. Every other cross member is a cross member 32 having these other members associated with it.

In contrast, cross member 33 has attached at its mid-point vertical brace 40 whose opposite end is attached to the bottom portion of top truss member 28. Thus, in the embodiment shown in FIG. 2, every other cross member includes a vertical brace 40. Lighting and signal warnings 42 are attached to each vertical brace 40. The construction recited herein allows ready access to lighting and warning signals 42 because there are no superstructure or support members between catwalk 44 and vertical braces 40, each of which supports a corresponding warning signal unit 42. Specifically, no side braces 30 interfere with the workman's access to warning signals 42.

A plurality of spaced horizontal ribs 46 is attached to first bottom truss member 24 and extend outwardly from the triangular cross section formed by truss members 24, 26, 28. Horizontal ribs 46 are welded to first bottom truss member 24. Catwalk 44, consisting of a pair of parallel longitudinal channel walkway members 45, is equipped with handrail 48 supported by handrail supports 50. Reinforcing rail 49 runs parallel to handrail 48 approximately midway between channel walkway members 45 and handrail 48.

Figure 1:
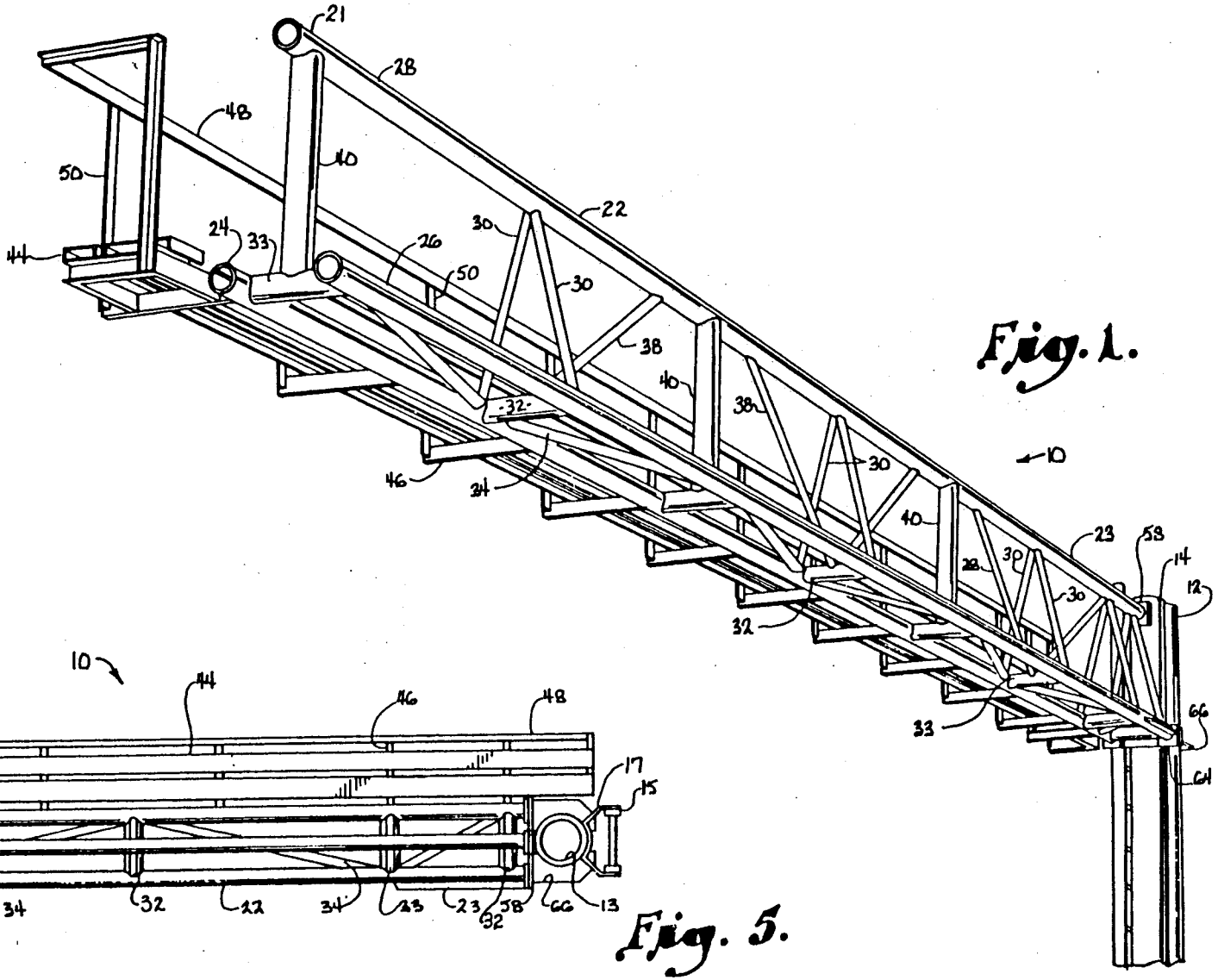
FIG. 1 is a perspective view of the triangular truss walkout cantilever primarily featuring the cantilever arm.
Figure 5:
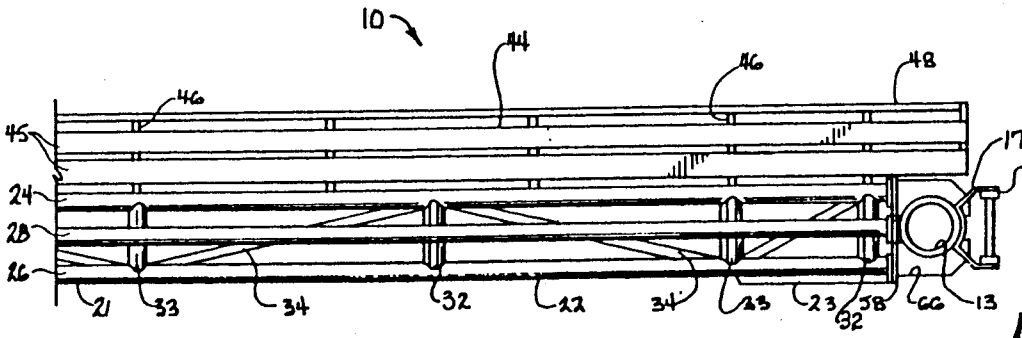
FIG. 5 is a plan view of the triangular truss walkout cantilever featuring a single mast model, simplified for clarity.

Triangular truss walkout cantilever 10 is designed for two-piece assembly in the field through means for joining a completed truss arm 22 to masts 12, 14 or in the case of a single mast cantilever (FIG. 5 only), mast 13. This end is accomplished by having matching plate brackets on the mounting end of truss arm 22 and mounting means attached to the masts. In particular, stub arm 52 penetrates apertures 54 through first mast 12 and second mast 14 and is welded thereto. Stub arm 52 terminates in upper bracket 58, which comprises a square metal plate bracket welded to tubular stub arm 52 and comprising an integral part thereof. Upper truss arm bracket 59 is a matching flat metal bracket welded to the mounting end of top truss member 28. Brackets 58, 59 include four apertures 60 adapted to receive nuts and bolts 62 for fastening these pieces together.

Caliper bracket 66 embraces some portions of the circumference of first mast 12 and second mast 14 and is welded thereto. Caliper bracket 66 terminates in mounting bracket 67, which is a rectangular metal plate bracket welded to caliper bracket and vertically oriented, and includes a plurality of apertures 60. Lower truss arm bracket 64 is a matching rectangular metal plate bracket welded to first bottom truss member 24 and second bottom truss member 28 and adapted for matching engagement with mounting bracket 67 and including a plurality of apertures 60 which align with the apertures in mounting bracket 67, allowing for connection of the mast and cantilever arm 22 by nuts and bolts 62.

Cantilever arm 22 includes a repeating pattern in which every other cross member 32 is associated with two center diagonals 38 and two side braces 30 while every other cross member 33 is associated with vertical braces 40. All cross members 32, 33 are associated with a bottom brace 34 which is in the plane defined by first bottom truss member 24 and second bottom truss member 26. This repeating pattern, however, does not begin precisely at the mounting end 23 of truss arm 22. The cross member 32 closest to mounting end 23 includes two side braces 30, a center diagonal 38, which is at a steeper angle (approximately forty-five degrees (45°) to the horizontal) than other center diagonals 38, and an associated bottom brace 34. These two particular side braces 30 join top truss member 28 adjacent to upper truss arm bracket 59.

It is to be understood that while certain forms of this invention have been illustrated and described, it is not limited thereto, except insofar as such limitations are included in the following claims.

Having thus described the invention, what is claimed as new and desired to be secured by Letters Patent is:

1. In a railroad warning system, a walkout cantilever comprising:

a base adapted to overlie a supporting pad;

an upright mast having a bottom end fixed to said base;

a horizontally disposed truss arm secured to and extending from said mast and including three longitudinal truss members disposed substantially parallel to one another, said truss members comprising a first bottom truss member, a second bottom truss member and a top truss member presenting a cross sectional triangular pattern having a horizontal base and an upwardly projecting apex;

means interlocking said longitudinal truss members, including a plurality of spaced cross members disposed essentially in the plane of said first and second bottom truss members and joined thereto, a vertical brace attached to and extending from a corresponding cross member to said top truss member, and two pairs of side braces spaced from said vertical brace in opposite longitudinal directions and extending to said top truss member from said first and second bottom truss members;

a signal light unit mounted on said vertical brace;

a catwalk extending along said truss arm substantially in the plane of said first and second bottom truss members; and means securing said catwalk to one of said bottom truss members.

2. The walkout cantilever as claimed in claim 1, wherein said interlocking means further includes two center diagonals spaced from said vertical brace in opposite longitudinal directions and extending to said top truss member from corresponding cross members exclusive of the cross member to which said vertical brace is attached, whereby the center diagonals also do not interfere with the signal light unit.

3. The walkout cantilever as claimed in claim 2, wherein said spaced cross members and first and second bottom truss members present a series of bottom, generally rectangular frames, and wherein said interlocking means further includes a generally diagonally disposed bottom brace within each of said frames.

4. In a railroad warning system, a walkout cantilever comprising:

a base adapted to overlie a supporting pad;

an upright mast having a bottom end fixed to said base;

a horizontally disposed truss arm secured to and extending from said mast and including three longitudinal truss members disposed substantially parallel to one another, said truss members comprising a first bottom truss member, a second bottom truss member and a top truss member presenting a cross sectional triangular pattern having a horizontal base and an upwardly projecting apex;

a plurality of spaced cross members disposed essentially in the plane of said first and second bottom truss members and joined thereto to present a series of bottom, generally rectangular frames;

a generally diagonally disposed bottom brace within each of said frames;

at least two vertical braces attached to and extending from corresponding cross members to said top truss member;

at least two longitudinally spaced center diagonals extending to said top truss member from corresponding cross members to which said vertical braces are not attached;

at least two longitudinally spaced pairs of side braces extending to said top truss member from locations on said truss arm adjacent corresponding cross members to which said vertical braces are not attached;

at least two signal light units, each mounted on a corresponding vertical brace;

a catwalk extending along said truss arm substantially in the plane of said first and second bottom truss members; and means securing said catwalk to one of said bottom truss members.

* * * * *